US006042297A

United States Patent [19]

Lah

[11] Patent Number: 6,042,297

[45] Date of Patent: Mar. 28, 2000

[54] LOCKING DEVICE FOR TENT POLES

[75] Inventor: Jeh-Kun Lah, Inchon, Rep. of Korea

[73] Assignee: Samjong International, Seoul, Rep. of Korea

[21] Appl. No.: 08/966,181

[22] Filed: Nov. 7, 1997

[30] Foreign Application Priority Data

Feb. 4, 1997 [KR] Rep. of Korea ..... 97-1681

[51] Int. Cl.[7] ..... B25G 3/00

[52] U.S. Cl. ..... 403/348; 403/353; 403/165; 403/14; 135/114; 135/127

[58] Field of Search ..... 403/348, 349, 403/350, 353, 361, 314, 165, 99, 13, 14, 308; 135/127, 114, 120.4, 30, 31, 32, 33.5

[56] References Cited

U.S. PATENT DOCUMENTS

| | | | |
|---|---|---|---|
| 2,367,458 | 1/1945 | Coplen | 403/350 X |
| 3,661,411 | 5/1972 | Flick . | |
| 3,730,544 | 5/1973 | Hyman | 403/99 X |
| 3,851,601 | 12/1974 | Davis | 403/349 X |
| 4,142,809 | 3/1979 | Shell | 403/348 X |
| 4,175,576 | 11/1979 | Iby | 135/120.4 X |
| 4,265,261 | 5/1981 | Barker | 135/120.4 X |
| 4,417,597 | 11/1983 | Montgomery | 135/127 |
| 4,640,639 | 2/1987 | Matsui | 403/348 X |
| 5,029,847 | 7/1991 | Ross | 135/114 X |
| 5,197,504 | 3/1993 | Howe | 135/127 |
| 5,375,938 | 12/1994 | Bartlow | 403/14 X |
| 5,628,336 | 5/1997 | Lee | 135/114 |
| 5,657,525 | 8/1997 | Hoyt, III et al. | 403/348 X |
| 5,683,199 | 11/1997 | Tehan | 135/127 X |

*Primary Examiner*—Terry Lee Melius
*Assistant Examiner*—William L. Miller
*Attorney, Agent, or Firm*—Knobbe, Martens, Olson & Bear, LLP

[57] ABSTRACT

A locking device for tent poles capable of achieving a firm and easy coupling to poles and easily and conveniently replacing a broken pole piece without replacing the entire pole including the broken pole piece. The locking device includes a mushroom tip member having a fitting portion fitted in one end of a tent pole, a V-shaped longitudinal groove formed on a peripheral surface of the fitting portion of the mushroom tip member, a guide groove formed on the peripheral surface of the fitting portion of the mushroom tip member in such a manner that it crosses the longitudinal groove, and a protrusion radially inwardly protruded from an inner surface of the pole piece corresponding to the end of the tent pole. The protrusion is engagable in both the longitudinal groove and guide groove at the cross point between the longitudinal groove and guide groove. The locking device may include a cap member adapted to couple the tent pole to a connector and provided with a fitting portion which is fitted in one end of the tent pole. The cap member has a spiral guide groove formed on a peripheral surface of the fitting portion. This locking device includes a protrusion radially inwardly protruded from an inner surface of the pole piece corresponding to the end of the pole, the protrusion being engagable in the spiral guide groove.

6 Claims, 7 Drawing Sheets

LOCKING DEVICE FOR TENT POLES

BACKGROUND OF THE INVENTION

1. Field of the Invention

The present invention relates to a locking device for tent poles, and more particularly to a locking device for tent poles including a rotating mushroom tip member or cap member capable of achieving a firm and easy coupling to poles and easily and conveniently replacing a broken pole piece.

2. Description of the Prior Art

Generally, tents are provided with a plurality of poles serving as a frame for setting up a tent. Such poles have a hollow cylindrical shape such as a pipe shape. Each pole consists of a plurality of pole pieces connected together by a rubber string having a good elasticity. The rubber string extends through the interior of the pole and is connected at both ends thereof to both ends of the pole, respectively. A pair of mushroom tip members or general tip members are attached to both ends of the pole, respectively. Each mushroom tip member or general tip member of the pole is inserted at its tip portion into one of eyelets provided at the lower edge of the tent, so as to couple the pole to the body of the tent.

Referring to FIG. 1, an example of a mushroom tip member is illustrated. As shown in FIG. 1, a mushroom tip member 12 is fitted in one end of a pole 10. The mushroom tip member 12 is provided at one end thereof with an annular stopper flange 14. The mushroom tip member 12 also has a fitting portion extending from the annular stopper flange 14 so that the mushroom tip member 12 is fitted in the pole 10.

For assembling such a mushroom tip member to the pole 10, a rubber string is first connected at one end thereof to a pole piece which constitutes the first pole piece of the pole 10. Thereafter, the remaining pole pieces of the pole 10 are sequentially connected to the first pole piece while the rubber string extends through the pole pieces. The other end of the rubber string is connected to the last pole to piece of the pole 10. A pair of mushroom tip members, which have a construction shown in FIG. 1 and are coated with an adhesive on their fitting portions, are then forcibly fitted into opposite ends of the pole 10, respectively.

Referring to FIG. 2, an example of a general tip member is illustrated. As shown in FIG. 2, a general tip member 18 is fitted in one end of a pole 16. The general tip member 18 is provided at one end thereof with an annular stopper flange 20. The general tip member 18 also has a fitting portion extending from the annular stopper flange 20. The fitting member has a coupling hole 24 for coupling a rubber string 22.

For assembling such a general tip member to the pole 16, one end of the rubber string 22 is first inserted into the coupling hole 24 of a general tip member 18 so that it is bound to the general tip member 18. In this state, the general tip member 18 is fitted in a pole piece which constitutes the first pole piece of the pole 16 while the rubber string 22 extends through the first pole piece. Thereafter, the remaining pole pieces of the pole 16 are sequentially connected to the first pole piece while the rubber string extends through the pole pieces. Subsequently, the other end of the rubber string emerging from the last pole piece of the pole 16 is bound to another general tip member 18 by inserting it into the coupling hole 24 of that general tip member 18. This second general tip member 18 is then fitted in the last pole piece of the pole 16.

On the other hand, FIG. 3 illustrates a conventional cap type pole locking device. As shown in FIG. 3, the pole locking device includes a cap member 28 which is adapted to be inserted into a pole 26. The cap member 28 is provided at one end thereof with an annular stopper flange 30. The cap member 28 also has an insert portion extending from the annular stopper flange 30. At the insert portion, the cap member 28 is provided with a coupling hole 34 for coupling a rubber string 32.

Such a cap type pole locking device is used in a state in which it is coupled to a connector 36 for connecting a plurality of poles together, as shown in FIG. 3.

For coupling the cap type pole locking device to the connector 36, one end of the rubber string 32 is first inserted into the coupling hole 34 of the cap member 28 so that the rubber string 32 is bound to the cap member 28. In this state, the other end of the rubber string 32 extends through the connector 36 and the pole pieces of the pole 26. The other end of the rubber string 32 is then connected to the last pole piece of the pole 26. Under this condition, the cap member 28 is coupled to the connector 36 by virtue of the elastic force of the rubber string 32 in such a manner that its insert portion is inserted in the connector 36.

In the case of the conventional mushroom tip member 12 shown in FIG. 1, it is hardly separated from its pole when its tip portion is inserted into an eyelet provided at a tent. This is because the mushroom tip member 12 is firmly fitted in its pole. During the setup of the tent, accordingly, the pole, which is bent in the form of a bow, is prevented from being resiliently separated. In this case, however, it is difficult to replace a broken pole piece by a new one. This is because a rubber string extends through all pole pieces of the broken pole in such a manner that its both ends are fixedly connected to both ends of the pole, respectively, and the mushroom tip member is fixedly coupled to the pole. That is, the replacement of the broken pole piece is difficult unless the mushroom tip member 12 is separated from the pole 10. In this case, therefore, it is necessary to replace the broken pole itself by a new one. This results in an increase in replacing costs.

In the case of the conventional general tip member shown in FIG. 2, an easy replacement of a broken pole piece is achieved because general tip members 18 are simply fitted in both ends of a pole and maintained in position only by the elastic force of a rubber string 22 extending through the pole. In this case, however, the general tip members 18 may be easily separated from its pole when their tip portions are inserted into eyelets provided at a tent. During the setup of the tent, accordingly, the pole, which is bent in the form of a bow, may be resiliently separated, like a projectile. In severe cases, the user may be injured.

In the case of the cap type pole locking device of FIG. 3 adapted to connect a plurality of poles 26 together, its cap member 28, which is inserted in the connector 36, is simply fitted in an associated pole when a tent is set up. In this case, the coupling between the cap member 28 and associated pole is maintained only by the elastic force of a rubber string 32 extending through the pole. As a result, the cap member 28 may easily be separated from the pole 26 and connector 36. Accordingly, it is troublesome to set up a tent. This also results in an increase in setup time.

SUMMARY OF THE INVENTION

Therefore, the present invention has been made in view of the above-mentioned problems, and its object is to provide a locking device for tent poles capable of achieving a firm and easy coupling to poles and easily and conveniently replacing a broken pole piece without replacing the entire pole including the broken pole piece.

In accordance with one aspect, the present invention provides a locking device for a tent pole consisting of a plurality of pole pieces, the locking device including a mushroom tip member having a tip portion, an annular stopper flange provided at one end of the tip portion, a fitting portion longitudinally extending from the stopper flange, the fitting portion being fitted in one end of the tent pole, and a coupling hole provided at the fitting portion and adapted to bind a rubber string for connecting the pole pieces together, comprising: a V-shaped longitudinal groove formed on a peripheral surface of the fitting portion of the mushroom tip member in such a manner that it is aligned with the center of the coupling hole; a guide groove formed on the peripheral surface of the fitting portion of the mushroom tip member in such a manner that it crosses the longitudinal groove; and a protrusion radially inwardly protruded from an inner surface of the pole piece corresponding to the end of the tent pole in which the fitting portion of the mushroom tip member is fitted, the protrusion being engagable in both the longitudinal groove and guide groove at the cross point between the longitudinal groove and guide groove.

In accordance with another aspect, the present invention provides a locking device for a tent pole consisting of a plurality of pole pieces, the locking device including a cap member adapted to couple the tent pole to a connector, the cap member having a tip portion, an annular stopper flange provided at one end of the tip portion, a fitting portion longitudinally extending from the stopper flange, the fitting portion being fitted in one end of the tent pole, and a coupling hole provided at the fitting portion and adapted to bind a rubber string for connecting the pole pieces together, comprising: a spiral guide groove formed on a peripheral surface of the fitting portion of the cap member; and a protrusion radially inwardly protruded from an inner surface of the pole piece corresponding to the end of the pole in which the fitting portion of the cap member is fitted, the protrusion being engagable in the spiral guide groove.

By the above-mentioned configuration, the mushroom tip member or cap member can be easily coupled to or separated from the tent pole. Accordingly, it is possible to rapidly and easily replace a broken pole piece by a new one without replacing the entire tent pole.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
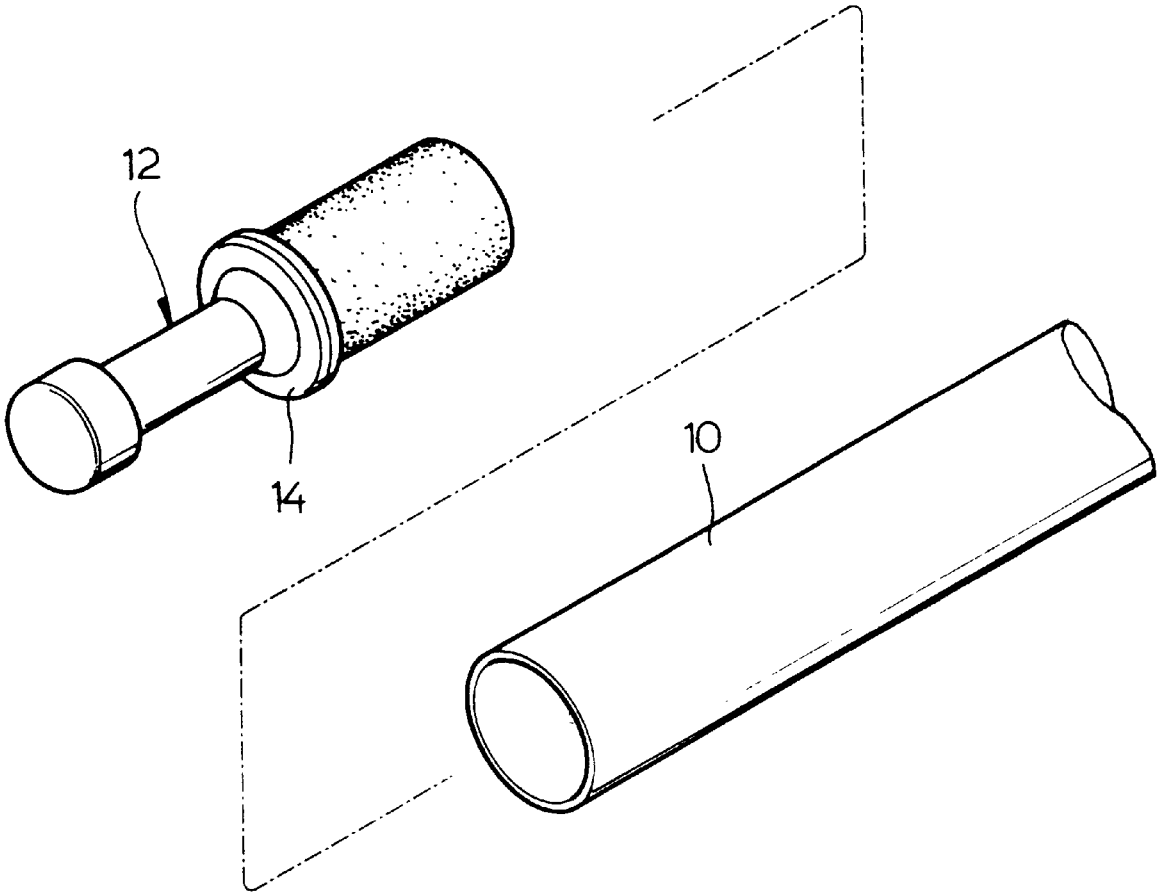
FIG.1 PRIOR ART
FIG. 1 is an exploded perspective view illustrating a conventional mushroom tip member for tent poles.
Figure 2:
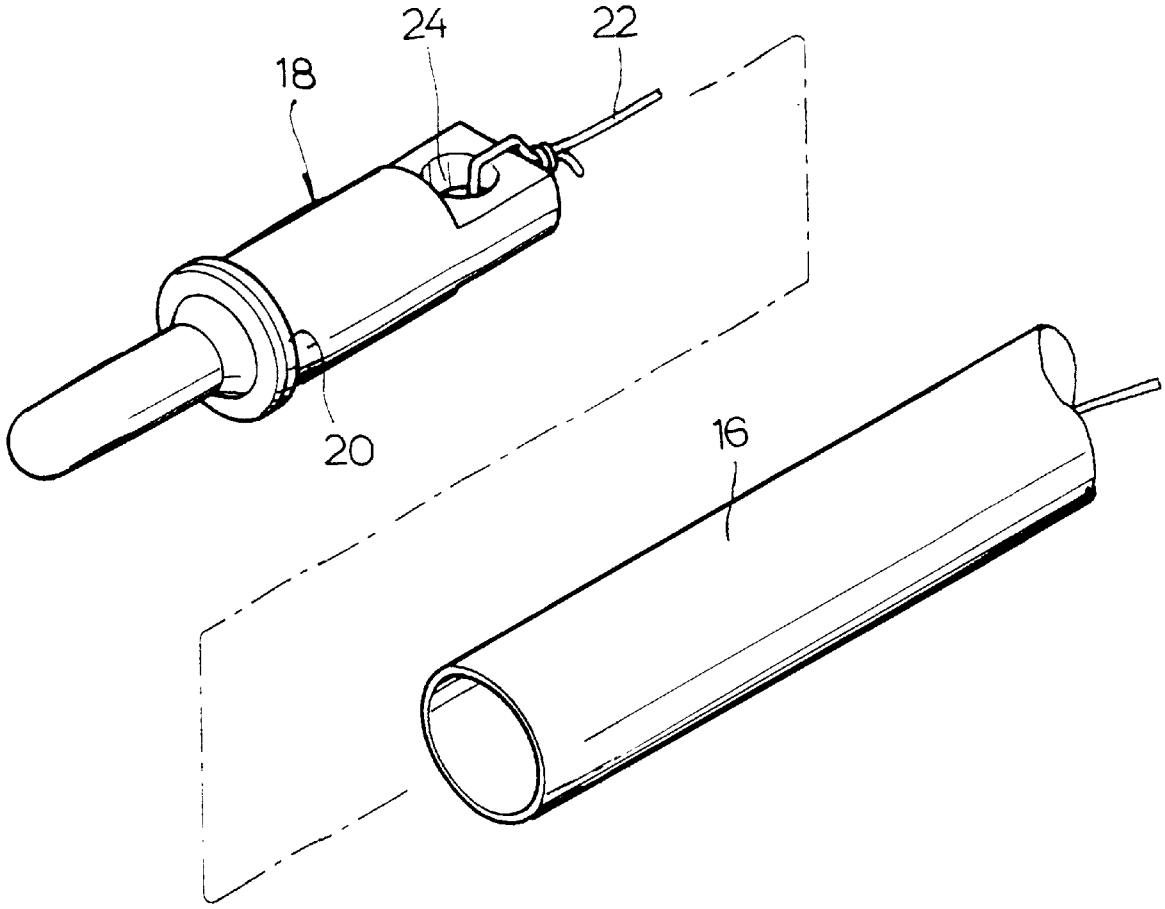
FIG.2 PRIOR ART
FIG. 2 is an exploded perspective view illustrating a conventional general tip member for tent poles.
Figure 3:
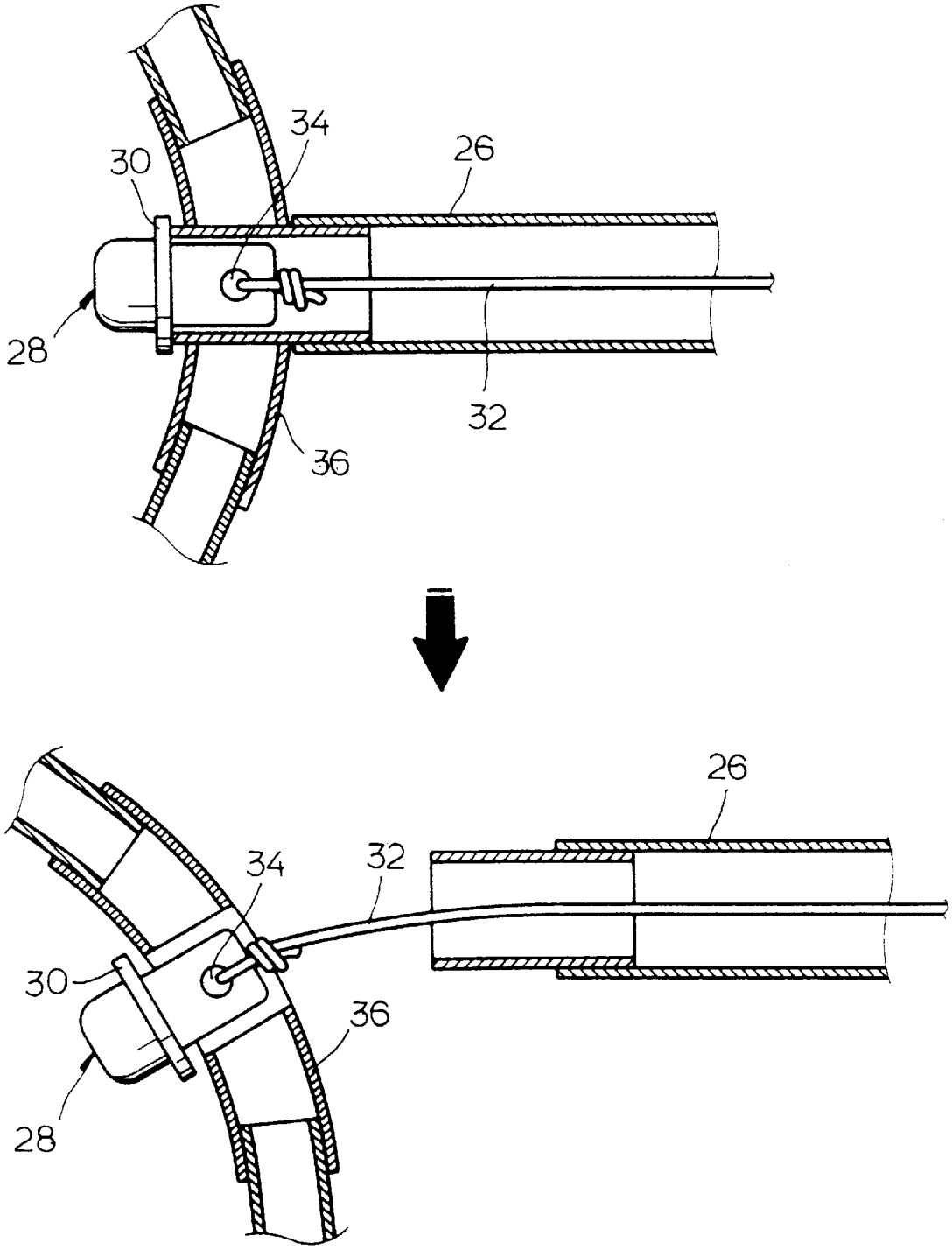
FIG.3 PRIOR ART
FIG. 3 is a sectional view illustrating a conventional cap member for tent poles.

Referring to FIGS. 4 to 8, embodiments of a locking device for tent poles in accordance with the present invention are illustrated, respectively. In FIGS. 4 to 8, elements respectively corresponding to those in FIGS. 1 to 3 are denoted by the same reference numerals. Accordingly, no detailed description will be made for these elements. For these elements, only a difference in configuration will be described.

In FIGS. 4 to 7, a pole locking device according to an embodiment of the present invention is illustrated. As shown in FIGS. 4 to 7, the pole locking device includes a mushroom tip member 42 which is fitted in one end of a pole piece 40.

Figure 6:
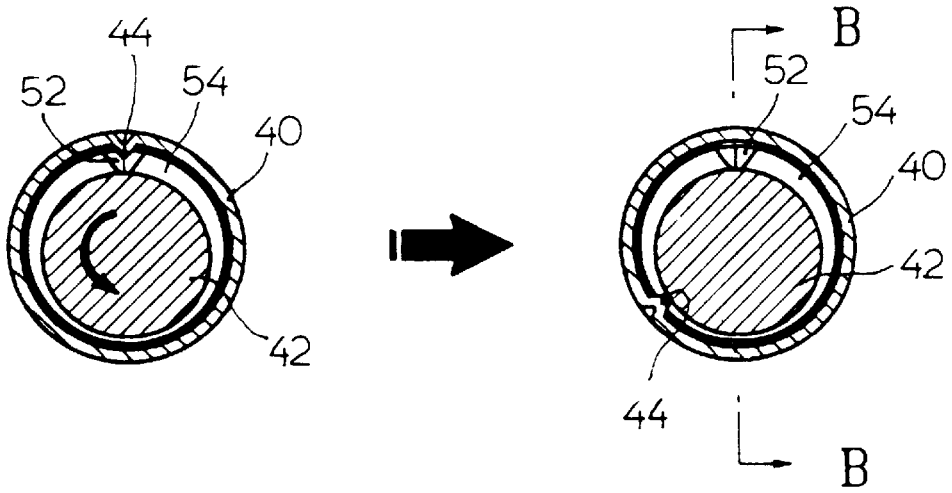
FIG. 6 is a sectional view taken along the line A—A of FIG. 5.
Figure 7:
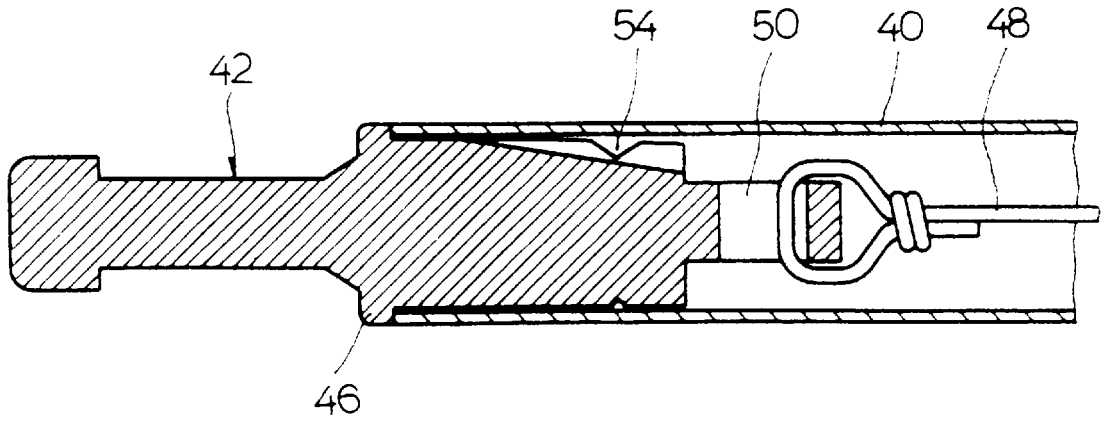
FIG. 7 is a sectional view taken along the line B—B of FIG. 6.

In accordance with the present invention, the pole piece 40 has a protrusion 44 radially inwardly protruded from the inner surface of the pole piece. The mushroom tip member 42 engages with the protrusion 44 and has an annular stopper flange 46, and a fitting portion which is fitted in the pole piece 40. At the fitting portion, the mushroom tip member 42 is provided with a coupling hole 50 for coupling a rubber string 48 to the mushroom tip member 42. A longitudinal groove 52 having a V-shaped cross section is formed on the peripheral surface of the fitting portion of the mushroom tip member 42. The longitudinal groove 52 is aligned with the center of the coupling hole 50. The mushroom tip member 42 also has a guide groove 54 which is formed on the peripheral surface of the fitting portion in such a manner that it crosses the longitudinal groove 52. The guide groove 54 has a width and a depth which decrease gradually as the guide groove 54 extends circumferentially from the longitudinal groove 52. This configuration is best shown in FIG. 6.

Figure 8:
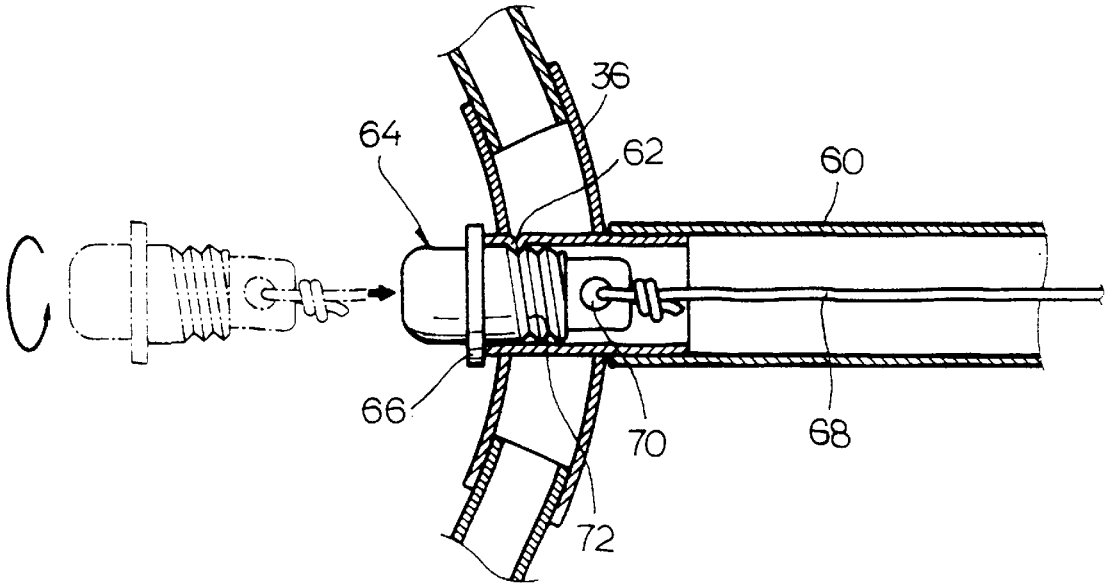
FIG. 8 is a sectional view illustrating a pole locking device including a cap member in accordance with another embodiment of the present invention.

In FIG. 8, a cap type pole locking device according to another embodiment of the present invention is illustrated. This cap type pole locking device is used in association with a connector for coupling a plurality of poles together. This pole locking device includes a cap member 64 which is inserted into the connector and fitted in one end of an associated pole piece of a pole which is one of the poles. The pole piece, in which the cap member 64 is fitted, is denoted by the reference numeral 60 in FIG. 8. In accordance with this embodiment of the present invention, the pole piece 60 is provided with a protrusion 62 radially inwardly protruded from the inner surface of the pole piece. The cap member 64 engages with the protrusion 62 of the pole piece 60 and has an annular stopper flange 66, and a fitting portion which is fitted in the pole piece 60. At the fitting portion, the cap member 64 is provided with a coupling hole 70 for coupling a rubber string 68 to the cap member 64. A spiral guide groove 72 is formed on the peripheral surface of the fitting portion of the cap member 64.

Figure 4:
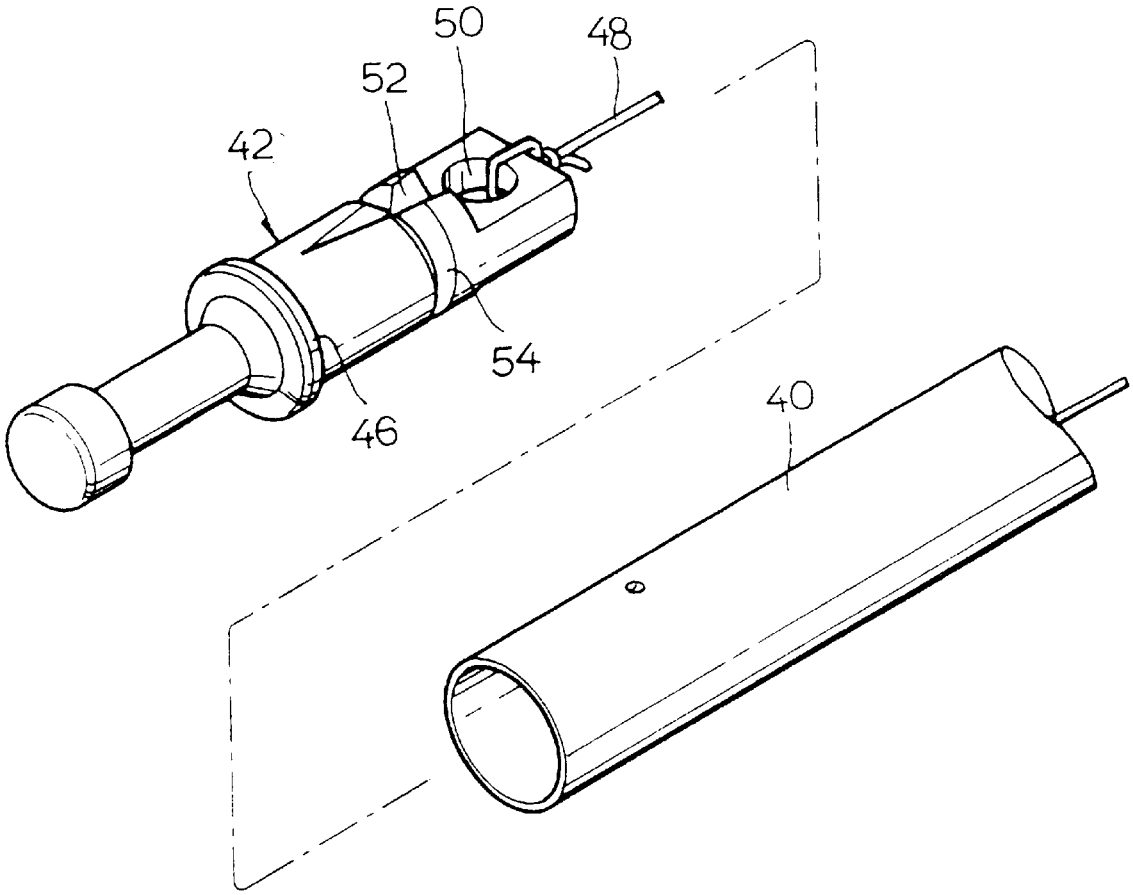
FIG. 4 is an exploded perspective view illustrating a pole locking device including a mushroom tip member in accordance with an embodiment of the present invention.
Figure 5:
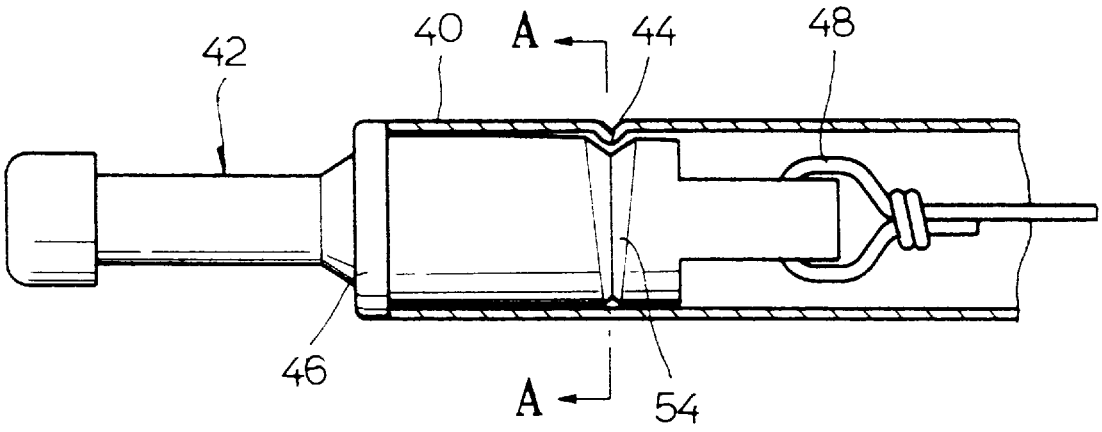
FIG. 5 is a sectional view illustrating a state in which the mushroom tip member of FIG. 4 is fitted in a pole piece.

For assembling the pole locking device of the first embodiment of the present invention to a pole, one end of the rubber string 48 is first inserted into the coupling hole 50 of the mushroom tip member 42 and then bound to the mushroom tip member 42, as shown in FIGS. 4 and 5. In this state, the other end of the rubber string 48 extends through the pole piece 40, which is the first pole piece of the pole, and remaining pole pieces (not shown) of the pole in a sequential manner, thereby causing all the pole pieces of the pole to be connected together. At this time, the mushroom tip member 42 is fitted in one end of the pole piece 40 in such a manner that the protrusion 44 is disposed at the cross point between the longitudinal groove 52 and guide groove 54 while the stopper flange 46 is in contact with the end surface of the pole piece 40.

When the user rotates the mushroom tip member 42 through a desired angle in one direction using his fingers, in the state in which the mushroom tip member 42 is fitted in the pole piece 40, the protrusion 44 formed on the inner surface of the pole piece 40 slides along the guide groove 54 formed on the peripheral surface of the mushroom tip member 42. As the mushroom tip member 42 further rotates, the protrusion 44 is tightly engaged in the guide groove 54 because the guide groove 54 has a width and a depth which decrease gradually as the guide groove 54 extends circumferentially from the longitudinal groove 52. In this state, the mushroom tip member 42 is prevented from further rotating. Thus, the mushroom tip member 42 is firmly coupled to the pole piece 40.

Where at least one of pole pieces connected together to constitute a tent pole using the pole locking device of FIG. 4 should be replaced by a new one due to its breakage or failure of its function, the user rotates the mushroom tip 42 in a direction reverse to the rotation direction upon assembling the mushroom tip 42. The rotation of the mushroom tip member 42 is continued until the protrusion 44 of the pole piece 40 is aligned with the longitudinal groove 52 of the mushroom tip member 42. In this alignment state, the mushroom tip member 42 is separated from the pole piece 40.

Thereafter, the rubber string 48 is released and then separated from the coupling hole 50 of the mushroom tip member 42. The pole pieces are then separated from the rubber string 48, thereby causing them to be separated from one another. In this state, the broken pole piece can be replaced by a new one. After the replacement of the broken pole piece, the rubber string 48 extends through the pole pieces of the pole to connect those pole pieces together in the same manner as mentioned above. The rubber string 48 is then bound at its one end to the mushroom tip member 42. In this state, the mushroom tip member 42 is fitted in the pole piece 40 and coupled to the pole piece 40 by its rotation.

For assembling the cap type pole locking device of the second embodiment of the present invention to a pole by means of a connector, one end of the rubber string 68 is first inserted into the coupling hole 70 of the cap member 64 and then bound to the cap member 64, as shown in FIG. 8. In this state, the other end of the rubber string 68 extends through the pole piece 60, which is the first pole piece of the pole, and remaining pole pieces (not shown) of the pole in a sequential manner, thereby causing all the pole pieces of the pole to be connected together. Thereafter, the cap member 64 is inserted into the end of the pole piece 60, which is fitted in a hole provided at the connector, in such a manner that the protrusion 62 of the pole piece 60 engages in the spiral guide groove 72 of the cap member 64. In this state, the cap member 64 rotates in a desired direction until its stopper flange 66 comes into contact with the end surface of the pole piece 60. Thus, the cap member 64 is firmly coupled to the pole piece 60.

Where the cap member 64 coupled to the pole piece 60 is desired to be separated from the pole piece 60, the user rotates the cap member 64 in a direction reverse to the rotation direction upon assembling the cap member 64. By this rotation, the cap member 64 can be easily separated from the pole piece 60.

As mentioned above, in the case of the conventional mushroom tip member of FIG. 1 including a mushroom tip member firmly fitted in a pole, it is hardly separated from its pole where a broken pole piece should be replaced by a new one. In the case of the conventional general tip member shown in FIG. 2, it may be easily separated from its pole because it is simply fitted in a pole and maintained in position only by the elastic force of a rubber string extending through the pole. In the case of the cap type pole locking device of FIG. 3, the same problem as in the case of FIG. 2 occurs. As a result, there is a degradation in the tent setup efficiency in all the conventional pole locking devices. In accordance with the first embodiment of the present invention, however, a pole locking device is provided which includes a longitudinal groove and a guide groove to provide easy coupling and separation of a mushroom tip member. In accordance with the second embodiment of the present invention, a pole locking device is provided which includes a spiral guide groove to provide easy coupling and separation of a cap member. In either case of the present invention, it is possible to rapidly and easily replace a broken pole piece by a new one without replacing the entire pole. It is also possible to prevent the tent setup work to be troublesome. It is also possible to prevent an increase in the tent setup time.

As apparent from the above description, the present invention provides a pole locking device including a longitudinal groove provided at a mushroom tip member or a spiral guide groove provided at a cap member. A protrusion provided at a pole engages in the longitudinal groove or spiral guide groove, so that the mushroom tip member or cap member can be easily coupled to or separated from a pole. Accordingly, it is possible to rapidly and easily replace a broken pole piece by a new one without replacing the entire pole.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. In combination, a locking device and one pole piece of a multi-piece tent pole, the combination comprising, a mushroom tip member having a tip portion, an annular stopper flange provided at one end of the tip portion, a fitting portion longitudinally extending from the stopper flange, the fitting portion being fitted in one end of the pole piece, and a coupling hole provided at the fitting portion and adapted to bind a rubber string for connecting other pole pieces of the tent pole together;

a V-shaped, longitudinal groove formed on a peripheral surface of the fitting portion of the mushroom tip member in such a manner that it is aligned with the center of the coupling hole;

a guide groove formed on the peripheral surface of the fitting portion of the mushroom tip member in such a manner that it crosses the longitudinal groove; and a protrusion radially inwardly protruded from an inner surface of the one pole piece, the protrusion being engaged in both the longitudinal groove and guide groove at the cross point between the longitudinal groove and guide groove;

wherein the guide groove has a width and a depth which decrease gradually as the guide groove extends circumferentially from the longitudinal groove.

2. The combination in accordance with claim 1, wherein the guide groove formed on the peripheral surface of the fitting portion of the mushroom tip member is a spiral guide groove.

3. An apparatus for use in joining a multi-piece tent pole, the apparatus comprising:

a tip member having a head portion;

a cylindrical fitting portion extending from the head portion along a longitudinal axis, the fitting portion being adapted to fitted into one end of a tent pole piece;

an annular flange formed between the head portion and the fitting portion, the annular flange being adapted to stop the head portion being entered into the tent pole piece;

a planar coupling portion extending from the cylindrical fitting portion along the longitudinal axis;

a coupling hole formed on the planar coupling portion, the coupling hole being adapted to bind a rubber string for connecting other pole pieces of the tent pole;

a spiral guide groove formed on a peripheral surface of the cylindrical fitting portion;

a hollow tent pole piece having an inner surface, wherein an inwardly radially protrusion is formed on the inner surface near one end the tent pole piece, whereby the protrusion is engaged with the spiral guide groove when the tip member and the tent pole piece is assembled; and a connector for coupling the hollow tent pole piece to another tent pole piece wherein the connector comprises a through-hole and at least one coupling portion, the through-hole is adapted to pass the one end of the hollow tent pole piece with the protrusion therethrough, each of the at least one coupling portion is adapted to couple with another tent pole piece, whereby when the apparatus is assembled, while the one end of the hollow tent pole piece is passed through the through-hole, the protrusion of the hollow tent pole piece passed through the through-hole is engaged with the spiral groove of the tip member and the flange of the tip member is stopped by a circumference of the through-hole of the connector.

4. An apparatus for use in joining a multi-piece tent pole, comprising a tip member which comprises:

a head portion;

a fitting portion longitudinally extending from the head portion, the fitting portion being adapted to fitted into one end of a tent pole piece;

an annular flange formed between the head portion and the fitting portion, the annular flange being adapted to stop the head portion being entered into the tent pole piece;

a coupling hole provided at the fitting portion, the coupling hole being adapted to bind a rubber string for connecting other pole pieces of the tent pole;

a longitudinal groove formed on a peripheral surface of the fitting portion; and a guide groove formed on the peripheral surface of the fitting portion such that the guide groove crosses the longitudinal groove, wherein the guide groove has a width and a depth which decrease gradually as the guide groove extends circumferentially from the longitudinal groove.

5. An apparatus as defined in claim 4, wherein the longitudinal groove is a V-shaped groove.

6. An apparatus as defined in claim 5, further comprising a hollow tent pole piece having an inner surface, wherein an inwardly radially protrusion is formed on the inner surface near one end the tent pole piece, whereby the protrusion is engaged with the guide groove when the tip member and the tent pole piece is being assembled.

* * * * *